US009702625B2

(12) United States Patent
Kim et al.

(10) Patent No.: US 9,702,625 B2
(45) Date of Patent: Jul. 11, 2017

(54) LAUNDRY TREATMENT APPARATUS

(71) Applicant: LG Electronics Inc., Seoul (KR)

(72) Inventors: Jeongyun Kim, Seoul (KR); Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 669 days.

(21) Appl. No.: 14/138,818

(22) Filed: Dec. 23, 2013

(65) Prior Publication Data

US 2014/0182156 A1 Jul. 3, 2014

(30) Foreign Application Priority Data

Dec. 31, 2012 (KR) ..... 10-2012-0157985

(51) Int. Cl.

| | |
|---|---|
| ***D06F 58/22*** | (2006.01) |
| ***F26B 21/00*** | (2006.01) |
| ***D06F 58/02*** | (2006.01) |
| *D06F 58/28* | (2006.01) |

(52) U.S. Cl.

CPC ..... *F26B 21/003* (2013.01); *D06F 58/02* (2013.01); *D06F 58/22* (2013.01); *D06F 58/28* (2013.01); *D06F 2058/2854* (2013.01)

(58) Field of Classification Search

CPC ..... F26B 21/003; D06F 58/22; D06F 58/02; D06F 58/28; D06F 2058/2854

See application file for complete search history.

(56) References Cited

U.S. PATENT DOCUMENTS

| | | | |
|---|---|---|---|
| 9,062,410 | B2 | 6/2015 | Ahn |
| 2011/0225837 | A1 | 9/2011 | Ahn |
| 2011/0271543 | A1 | 11/2011 | Kim et al. |
| 2012/0084992 | A1 | 4/2012 | Shin et al. |
| 2014/0157621 | A1 | 6/2014 | Kim |

FOREIGN PATENT DOCUMENTS

| | | | |
|---|---|---|---|
| CN | 102257208 | A | 11/2011 |
| CN | 102653918 | A | 9/2012 |
| CN | 103866528 | A | 6/2014 |
| DE | 102013224968 | | 6/2014 |

(Continued)

OTHER PUBLICATIONS

Chinese Office Action dated Jul. 22, 2015 for Chinese Application No. 2013107506378, with English Translation, 15 Pages.

(Continued)

*Primary Examiner* — Jiping Lu

(74) *Attorney, Agent, or Firm* — Fish & Richardson P.C.

(57) ABSTRACT

A laundry treatment apparatus includes a connection duct into which air inside a drum, which provides a laundry accommodation space, is discharged. The laundry treatment apparatus also includes a discharge duct configured to extend in a longitudinal direction of the drum and connected to the connection duct and a filter assembly including a filter unit located in the discharge duct to filter air and an impurity remover unit configured to remove and compress impurities remaining on the filter unit. The laundry treatment apparatus further includes a drive unit secured to the impurity remover unit. The drive unit is configured to reciprocate in a longitudinal direction of the filter unit to allow the impurity remover unit to reciprocate over a predetermined area of the filter unit.

20 Claims, 7 Drawing Sheets

(56) References Cited

FOREIGN PATENT DOCUMENTS

| | | | |
|---|---|---|---|
| EP | 2 055 825 | A1 | 5/2009 |
| EP | 2126187 | | 12/2009 |
| EP | 2341182 | | 7/2011 |
| EP | 2 495 363 | A1 | 9/2012 |
| FR | 2999195 | | 6/2014 |
| JP | H07-136396 | A | 5/1995 |
| KR | 10-0823328 | B1 | 4/2008 |
| KR | 10-2011-0123355 | A | 11/2011 |
| WO | WO 2008/074581 | A1 | 6/2008 |
| WO | WO 2010/071355 | A2 | 6/2010 |
| WO | WO 2011/139095 | A2 | 11/2011 |

OTHER PUBLICATIONS

United Kingdom Office Action dated Dec. 31, 2014 for Application No. 1322765.7, 2 pages.
United Kingdom Office Action dated May 1, 2014 for Application No. 1322765.7, in English, 7 Pages.
Office Action issued in German Application No. 102013227120.4 on Nov. 30, 2016, 4 pages.
Search Report issued in French Application No. 1363433 on Nov. 2, 2016, 11 pages (with English translation).

[Fig. 1

Fig. 2
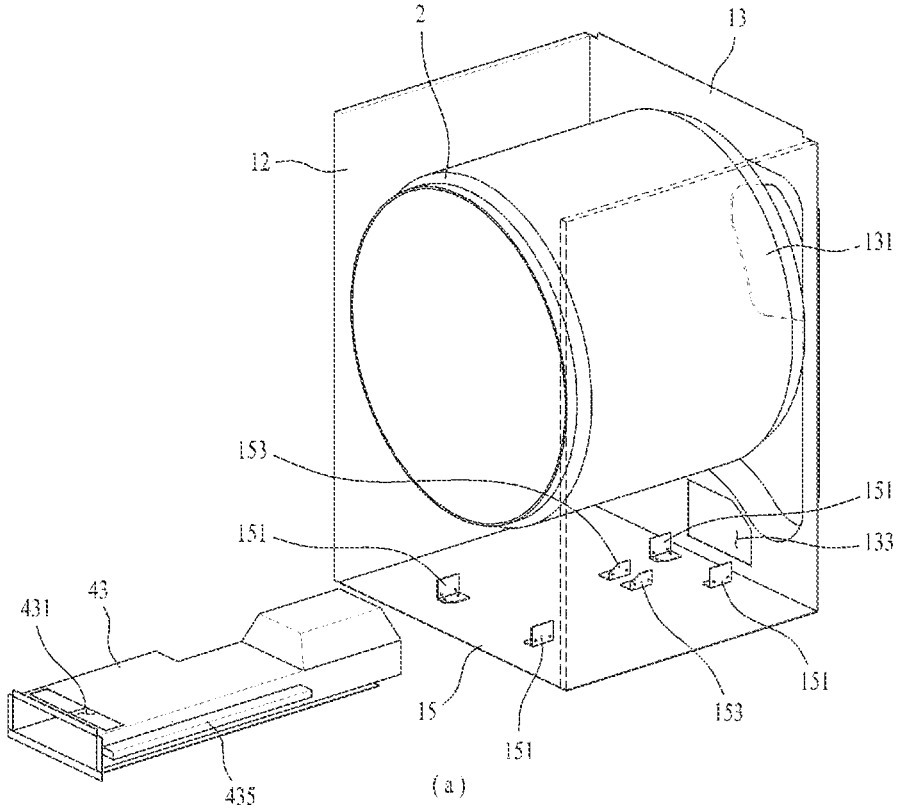
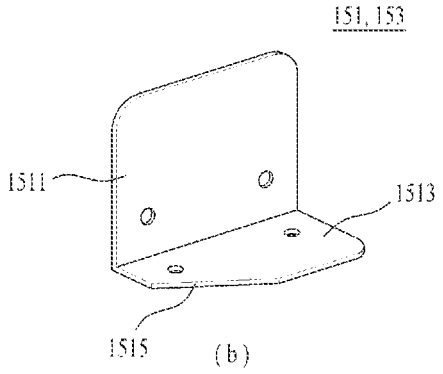

Fig. 5
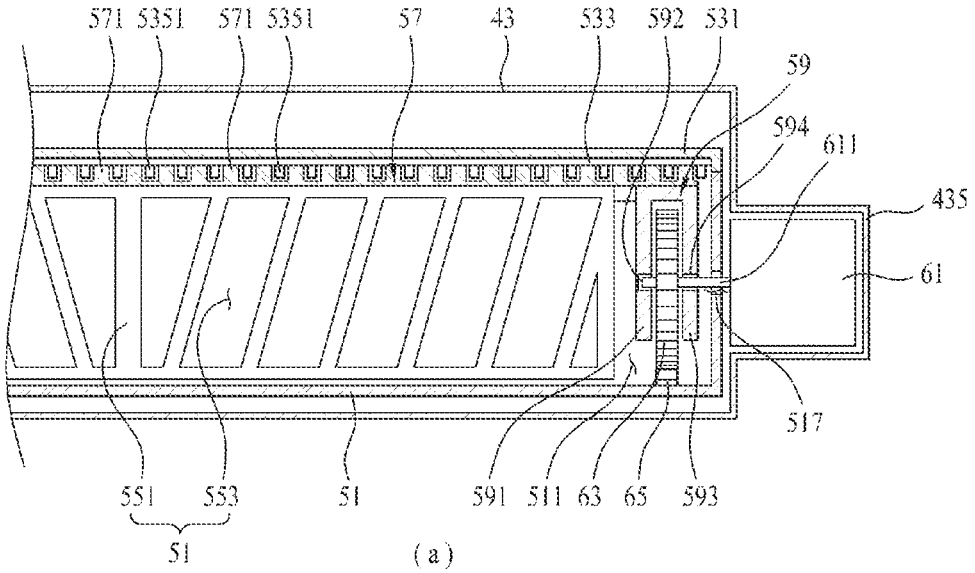
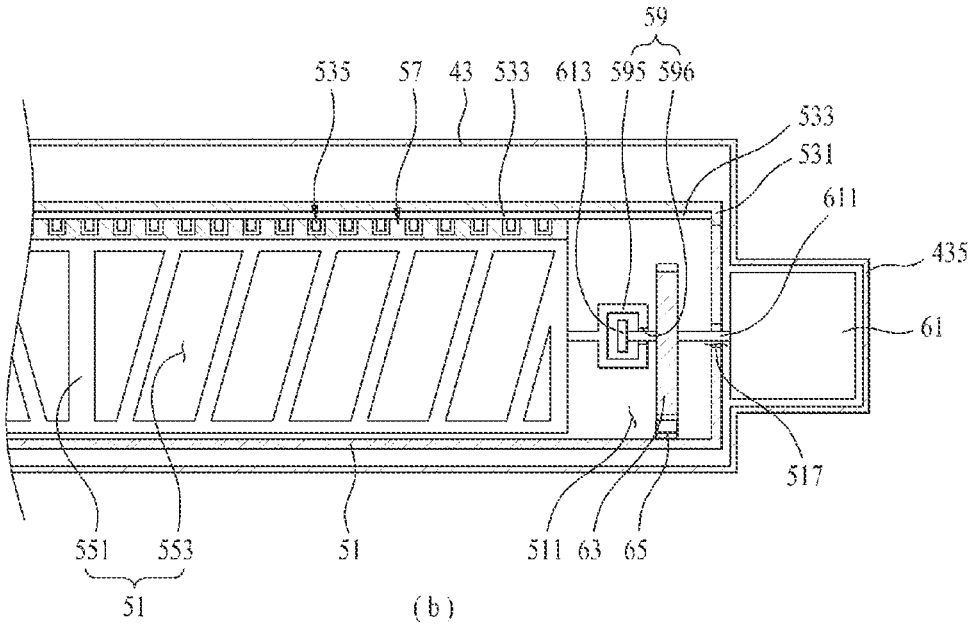

Fig. 6
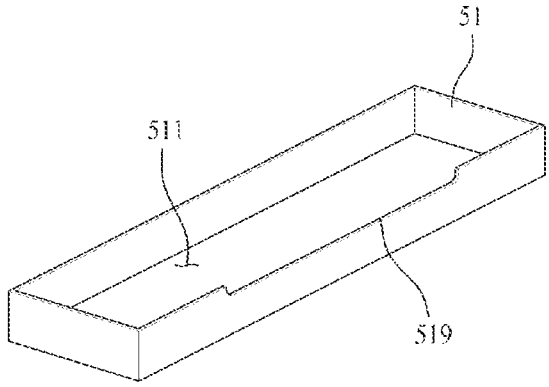
(a)
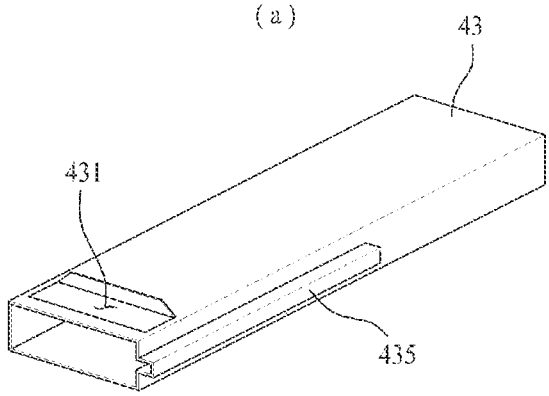
(b)
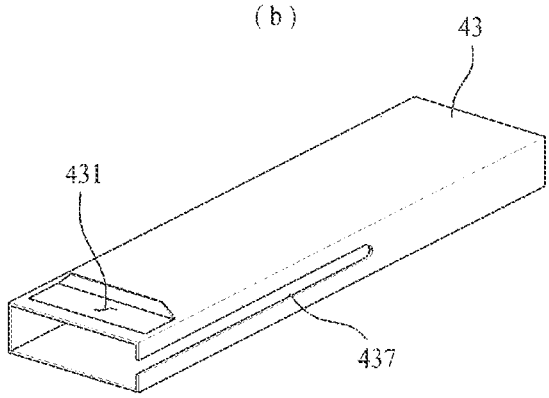
(c)

Fig. 7
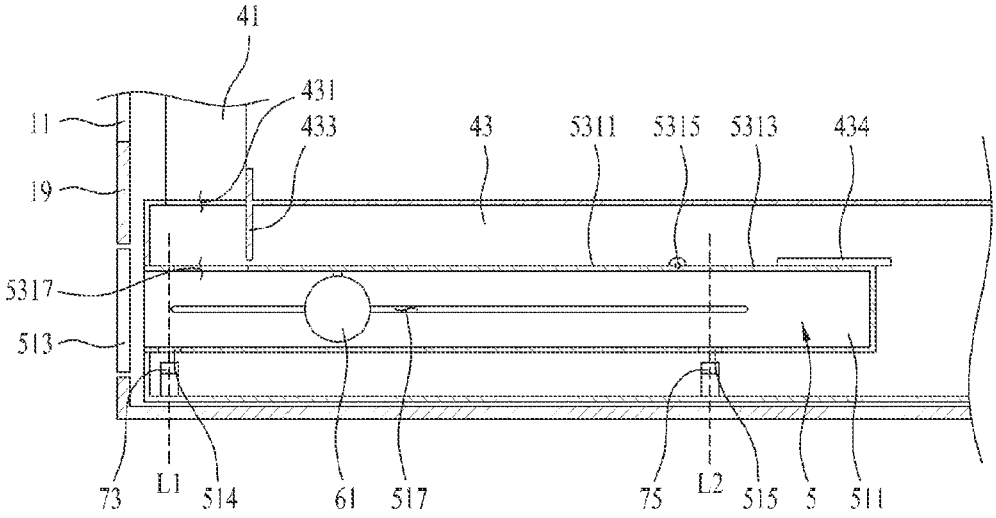
(a)
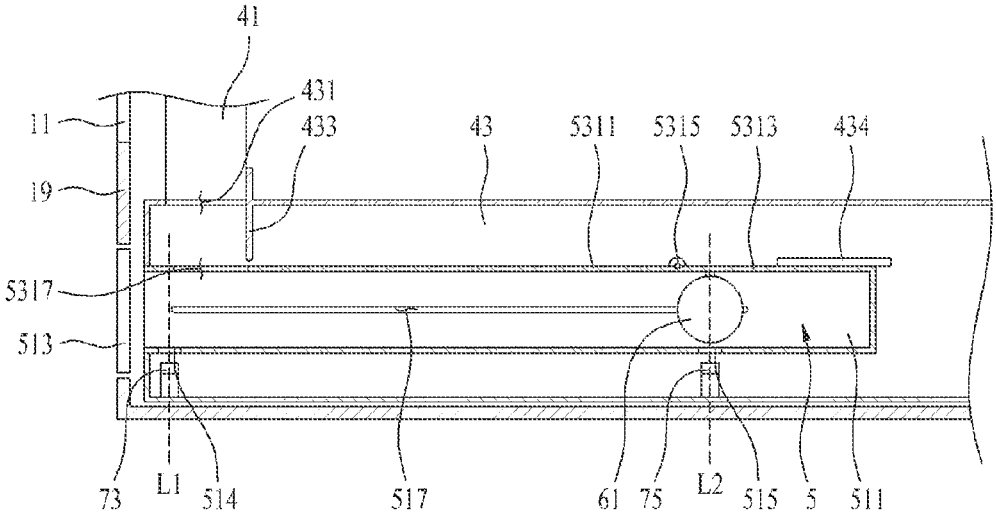
(b)

LAUNDRY TREATMENT APPARATUS

This application claims the benefit of Korean Patent Application No. 10-2012-0157985, filed on Dec. 31, 2012, which is hereby incorporated by reference as if fully set forth herein.

BACKGROUND OF THE INVENTION

Field of the Invention

The present invention relates to a laundry treatment apparatus.

Discussion of the Related Art

A laundry treatment apparatus is a generic term of home appliances including a washing machine for washing laundry, a laundry treatment apparatus for drying laundry, and a combined drying and washing machine for both washing and drying laundry.

Meanwhile, a laundry treatment apparatus capable of drying laundry (i.e. washed clothing) may be divided into an exhaust type laundry treatment apparatus and a circulation type laundry treatment apparatus.

More specifically, a laundry treatment apparatus may be divided into the exhaust type laundry treatment apparatus which is configured to discharge hot and humid air discharged from a drum to the outside of the laundry treatment apparatus, and the circulation type laundry treatment apparatus using a heat exchanger that implements condensation and heating of air discharged from a drum while hot and humid air discharged from the drum is resupplied into the drum (i.e. during circulation of air discharged from the drum).

The air discharged from the drum during drying may contain impurities (e.g., lint) dropped from an object to be dried, such as laundry. Accumulation of the impurities on internal components of the laundry treatment apparatus may cause breakdown of the laundry treatment apparatus, and the impurities discharged outward from the laundry treatment apparatus may cause air contamination of an indoor space where the laundry treatment apparatus is placed. Therefore, the laundry treatment apparatus having a drying function needs to remove the impurities from the air discharged from the drum.

A typical laundry treatment apparatus having a drying function includes a connection duct arranged in a height direction of a drum, and a discharge duct arranged in a longitudinal direction of the drum. The connection duct is provided with a filter to filter air discharged from the drum.

However, the size of the laundry treatment apparatus is generally determined according to national standards from around the world, and thus increasing the length of the connection duct (i.e. the length of the connection duct arranged in a height direction of the drum) is not easy. This is because increase in the length of the connection duct causes increase in the volume of the laundry treatment apparatus.

Such difficulty in increase in the length of the connection duct causes difficulty in increasing the filtration capacity of the filter provided at the connection duct of the typical laundry treatment.

In addition, the typical laundry treatment apparatus is inconvenient because a user needs to clean the filter whenever the user uses the laundry treatment apparatus after checking the quantity of impurities accumulated on the filter, in order to prevent deterioration of drying efficiency.

In the case of the typical laundry treatment apparatus, furthermore, the user has difficulty in judging whether or not the filter is mounted in the laundry treatment apparatus and therefore, the user may accidentally operate the laundry treatment apparatus despite the filter not being mounted in the laundry treatment apparatus.

In addition, the typical laundry treatment apparatus has no function of judging the quantity of impurities remaining on the filter, and may not inform the user of a cleaning time of the filter.

SUMMARY OF THE INVENTION

Accordingly, the present invention is directed to a laundry treatment apparatus that substantially obviates one or more problems due to limitation and disadvantages of the related art.

One object of the present invention is to provide a laundry treatment apparatus which may increase the filtration capacity of a filter.

Another object of the present invention is to provide a laundry treatment apparatus which may provide a configuration to increase the quantity of hot air to be supplied into a drum in which laundry is received and to increase the filtration capacity of a filter, thereby being usable as a commercial drying machine.

Another object of the present invention is to provide a laundry treatment apparatus which may judge whether or not a filter is mounted in the laundry treatment apparatus and judge the quantity of impurities remaining on the filter.

A further object of the present invention is to provide a laundry treatment apparatus which may inform a user of a cleaning time of a filter based on the quantity of impurities remaining on the filter.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the present invention, as embodied and broadly described herein, a laundry treatment apparatus includes a cabinet defining an external appearance of the laundry treatment apparatus, a drum rotatably placed within the cabinet and configured to receive laundry therein, a connection duct into which air inside the drum is discharged, a discharge duct configured to extend in a longitudinal direction of the drum and connected to the connection duct, a filter assembly including a filter unit located in the discharge duct to filter air and an impurity remover unit configured to remove and compress impurities remaining on the filter unit, and a drive unit secured to the impurity remover unit, the drive unit being configured to reciprocate in a longitudinal direction of the filter unit to allow the impurity remover unit to reciprocate over a predetermined area of the filter unit.

The cabinet may have a filter insertion hole communicating with the discharge duct, and the filter assembly and the drive unit may be retractable from the discharge duct through the filter insertion hole.

The filter assembly may further include a housing located in the discharge duct, the housing being configured to support the filter unit and to receive the impurity remover unit therein, and air discharged from the connection duct may be introduced into the housing and the housing may provide a storage space of the impurities removed from the filter unit by the impurity remover unit.

The filter unit may include a filter frame secured to the housing, an air introduction hole formed in the filter frame to allow the air discharged from the connection duct to be introduced into the housing, and a filter installed to the filter frame to filter the air to be moved from the housing to the discharge duct, and the impurity remover unit may be configured to reciprocate within the housing and serves to separate impurities remaining on the filter from the filter and compress the separated impurities within the housing.

The filter frame may include a first frame having the air introduction hole, the first frame being secured to the housing, and a second frame rotatably coupled to the first frame, the second frame being separable from the housing.

The drive unit may be configured to reciprocate in a longitudinal direction of the housing and serves to reciprocate the impurity remover unit within the housing.

The filter assembly may further include a slit formed in a longitudinal direction of the housing for communication between the interior and the exterior of the housing, and the drive unit may include a motor having a rotating shaft inserted into the slit and rotatably coupled to the impurity remover unit, the motor being located at the exterior of the housing, a rack located within the housing to extend in a longitudinal direction of the housing, and a motor gear coupled to the rotating shaft, the motor gear being located within the housing and engaged with the rack.

The impurity remover unit may include a compressor to which the rotating shaft is rotatably coupled, the compressor serving to compress impurities within the housing, and a brush protruding from the compressor to come into contact with the filter.

The filter assembly may further include a scraper coupled to the filter frame to separate impurities remaining on the brush from the brush.

The scraper may have a plurality of scraper bosses protruding from the filter frame, the brush may have a plurality of brush bosses protruding from the compressor, and the respective brush bosses may be configured to pass each space between one scraper boss and the other scraper boss.

The compressor may include a compression plate configured to reciprocate within the housing to compress impurities, and a shaft support portion secured to the compression plate, the rotating shaft being rotatably coupled to the shaft support portion.

The compressor may further include a through-hole perforated in the compression plate.

The shaft support portion may include a first flange secured to the compression plate and configured to receive the rotating shaft, and a second flange spaced apart from the first flange by a predetermined distance, the second flange having a shaft penetration hole for penetration of the rotating shaft, and the motor gear may be located in a space between the first flange and the second flange.

The laundry treatment apparatus may further include a position sensing unit configured to sense a position of the impurity remover unit.

The position sensing unit may include a magnetism generator secured to the impurity remover unit, and at least two magnetism sensors configured to generate a control signal if the magnetism generator reaches a preset position.

The filter assembly may further include a housing configured to receive the impurity remover unit and to secure the filter unit above the impurity remover unit such that impurities, removed from the filter unit by the impurity remover unit, are stored in the housing, a first hole perforated in a bottom surface of the housing, and a second hole perforated in the bottom surface of the housing and spaced apart from the first hole by a predetermined distance, and the magnetism sensors may include a first magnetism sensor fixed in the discharge duct at a position below the first hole, and a second magnetism sensor fixed in the discharge duct at a position below the second hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiment(s) of the invention and together with the description serve to explain the principle of the invention. In the drawings:

FIG. 2 is a view showing a coupling configuration of a base panel and a discharge duct according to the present invention;

FIG. 5 is a view showing a drive unit and an impurity remover unit provided in a filter assembly;

FIG. 6 is a view showing one example of a discharge duct and a housing provided in a filter assembly; and FIG. 7 is a view showing a storage quantity sensing unit (position sensing unit) provided in a laundry treatment apparatus of the present invention.

DETAILED DESCRIPTION OF THE INVENTION

Figure 1:
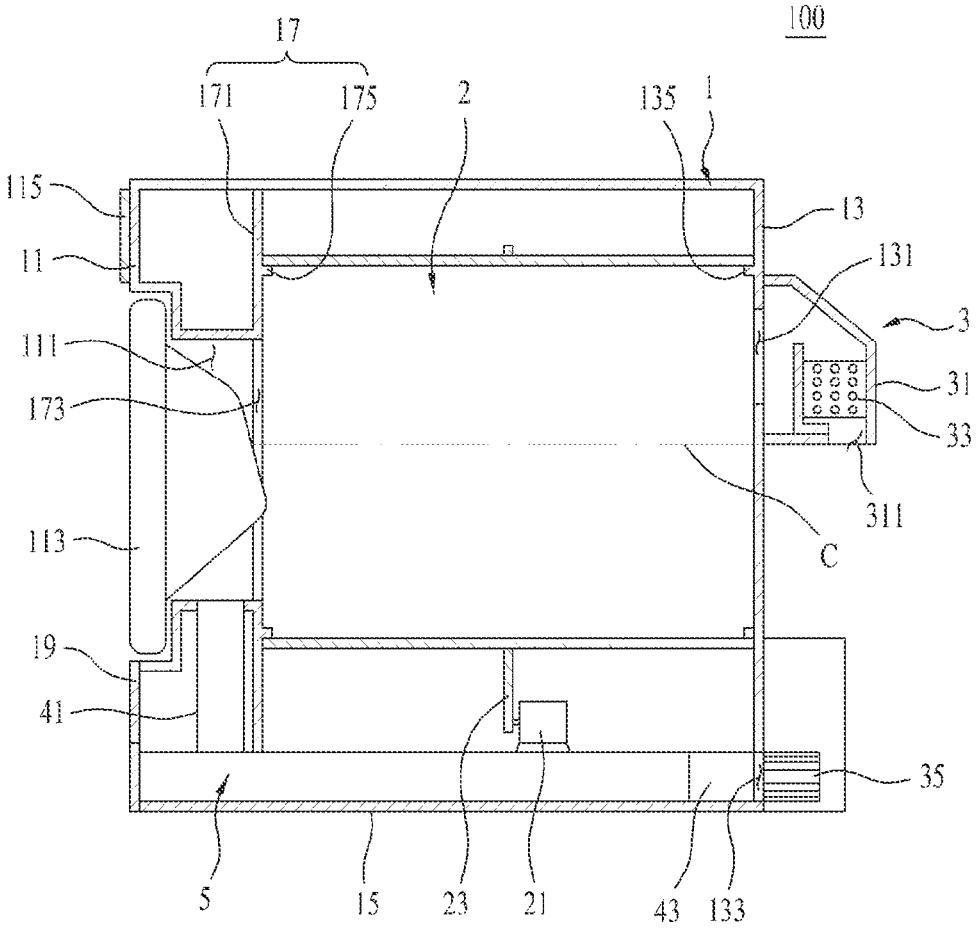
FIG. 1 is a view showing a configuration of a laundry treatment apparatus of the present invention.

Hereinafter, exemplary embodiments of the present invention will be described in detail with reference to the accompanying drawings. A configuration and a control method of an apparatus that will be described hereinafter are provided for explanation of the embodiments of the present invention, and are not intended to limit a technical range of the present invention. The same reference numerals of the entire specification designate the same constituent elements.

A laundry treatment apparatus 100 of the present invention, as exemplarily shown in FIG. 1, includes a cabinet 1 defining an external appearance of the laundry treatment apparatus 100, a drum 2 rotatably placed within the cabinet 1, the drum 2 being configured to receive laundry therein, an air supply unit 3 configured to supply heated air (hot air) or unheated air into the drum 2, a discharge path (4, see FIG. 3) configured to discharge air outwardly from the drum 2, and a filter assembly 5 configured to remove impurities from the air discharged from the drum 2.

The cabinet 1 is constituted of a front panel 11 having an opening 111, a rear panel 13 having an air inlet 131 that communicates with the interior of the drum 2, and a base panel 15 located below the drum 2, the front panel 11 and the rear panel 13 being supported by the base panel 15.

A user may put or take laundry into or out of the drum 2 through the opening 111. The opening 111 is opened or closed by a door 113 that is rotatably secured to the front panel 11.

A control panel 115 may be attached to the front panel 11. The control panel 15 is provided with an input unit (not shown) that allows the user to input control instructions to the laundry treatment apparatus 100 and a display unit (not shown) that displays control details of the laundry treatment apparatus 100.

The rear panel 13 is located opposite to the front panel 11 so as to face the front panel 11. The air inlet 131 is perforated in the rear panel 13 to allow air supplied from the air supply unit 3 to be introduced into the drum 2.

The rear panel 13 may further have an air outlet 133, through which the air discharged from the drum 2 through the discharge path 4 moves outward from the cabinet 1.

The rear panel 13 may further have a rear support flange 135 configured to rotatably support a rear surface of the drum 2. This will be described later in detail.

The base panel 15 serves to support the laundry treatment apparatus 100 on the ground. The front panel 11 and the rear panel 13 are secured to the base panel 15.

The base panel 15 may have duct guides 151 and 153 configured to facilitate assembly of a discharge duct 43 provided in the discharge path 4 and the air outlet 133 perforated in the rear panel 13. This will be described later in detail.

A drum support structure 17 is further provided within the cabinet 1 to rotatably support a front surface of the drum 2. The drum support structure 17 consists of a support body 171 secured to an inner surface of the cabinet 1 and a support structure through-hole 173 perforated in the support body 171 for communication between the opening 111 and the interior of the drum 2.

Accordingly, laundry introduced into the cabinet 1 through the opening 111 may move into the drum 2 through the support structure through-hole 173.

The drum support structure 17 may further include a front support flange 175 configured to rotatably support the front surface of the drum 2. The front support flange 175 is formed at an outer periphery of the support structure through-hole 173.

In this case, the diameter of the front support flange 175 may be greater than the diameter of the support structure through-hole 173 in consideration of the diameter of the drum 2.

The drum 2 may take the form of a cylinder, the front surface and the rear surface of which are open. As described above, the front surface of the drum 2 is rotatably supported by the front support flange 175, and the rear surface of the drum 2 is rotatably supported by the rear support flange 135.

A drum drive unit is provided to rotate the drum 2. The drum drive unit may include a drum motor 21, and a belt 23 that connects a rotating shaft of the drum motor 21 and an outer peripheral surface of the drum 2 to each other.

The air supply unit 3 serves to supply heated air or unheated air into the drum 2 to induce heat exchange between laundry and the air. The air supply unit 3 may include a heater housing 31 formed at the rear panel 13, a heater (heating means) 33 accommodated in the heater housing 31, and a fan 35 located in the discharge path 4 (more particularly, located in a connection duct 41 or the discharge duct 43).

The heater housing 31 is configured to enclose the air inlet 131 perforated in the rear panel 13, and has a housing inlet 311 for introduction of air into the heater housing 31.

Providing the heater housing 31 at the exterior of the cabinet 1 rather than the interior of the cabinet 1 further increases the drying capacity of laundry.

If the quantity of laundry increases, it is necessary to supply a greater quantity of air into the drum 2 to achieve drying of laundry within a predetermined time. Accordingly, to dry a great quantity of laundry, the laundry treatment apparatus 100 needs to increase the quantity of air to be supplied into the drum 2, and must have a large capacity heater (heating means) that may heat a great quantity of air.

If the large capacity heater is placed within the cabinet 1, however, the volume of the cabinet 1 is increased. Moreover, the large capacity heater may increase an internal temperature of the cabinet 1, which causes damage to internal components within the laundry treatment apparatus 100.

To solve the above-described problem, in the laundry treatment apparatus 100 of the present invention, the air supply unit 3 is secured to the exterior of the cabinet 1. As such, the laundry treatment apparatus 100 of the present invention may be utilized as a commercial laundry treatment apparatus that must be capable of drying large amounts of laundry per load.

The discharge path 4, as described above, serves to discharge air inside the drum 2 to the outside of the cabinet 1. The discharge path 4 may include the connection duct 41 arranged in a height direction of the drum 2 (perpendicular to a rotating axis C of the drum 2), and the discharge duct 43 arranged in a longitudinal direction of the drum 2, through which air supplied from the connection duct 41 is discharged to the outside of the cabinet 1.

The connection duct 41 is located below the opening 111 (in front of the support structure through-hole 173) and serves to move air inside the drum 2 to the discharge duct 43. That is, the connection duct 41 connects an outer periphery of the opening 111 and a duct connection hole (431, see FIG. 3) of the discharge duct 43 to each other.

The discharge duct 43 is configured to connect the connection duct 41 and the air outlet 133 to each other, and serves to discharge the air discharged from the drum 2 through the connection duct 41 to the outside of the cabinet 1.

In this case, the fan 35 included in the air supply unit 3 may be secured to the exterior of the cabinet 1 to suction air inside the discharge duct 43.

To dry a great quantity of laundry, as described above, it is essential to achieve large air volume. However, it is not easy to install a large capacity fan within the cabinet 1 having a limited volume.

Accordingly, as exemplarily shown in FIG. 1, the fan 35 is secured to the rear panel 13 to outwardly discharge air inside the drum 2 through the air outlet 133, which enables installation of a large capacity fan without change in the size of the cabinet 1.

The discharge duct 43, as exemplarily shown in FIG. 2, is generally secured to the base panel 15 after the drum 2 is assembled with the base panel 15.

In this case, for assembly of the discharge duct 43, a worker needs to push the discharge duct 43 from the front side of the drum 2 toward the rear panel 13 in order to couple the discharge duct 43 into the air outlet 133 of the rear panel 13. However, if the drum 2 obstructs worker's field of vision and thus the worker cannot check a position of the air outlet 133, the worker may have difficulty in coupling the discharge duct 43 into the air outlet 133.

Accordingly, the base panel 15 may be provided with the duct guides 151 and 153 to facilitate coupling of the discharge duct 43 and the air outlet 133.

The duct guides may include at least one pair of position guides 151 and at least one height guide 153. The position guides 151 assist both lateral sides of the discharge duct 43 in coinciding with both lateral sides of the air outlet 133, and the height guide 153 assists the top and bottom of an outer peripheral surface of the discharge duct 43 in coinciding with the top and bottom of an outer periphery of the air outlet 133.

Providing the position guide 151 and the height guide 153 with the same configuration is advantages in terms of reduction of manufacturing costs. To this end, each of the position guide 151 and the height guide 153 consists of a first plate 1511 and a second plate 1513 extending perpendicular to the first plate 1511, the second plate 1513 having a slope 1515.

The position guide 151 is secured to the base panel 15 via the second plate 1513, whereas the height guide 153 is secured to the base panel 15 via the first plate 1511.

Accordingly, once the discharge duct 43 is inserted into a space defined by the pair of position guides 151, both lateral sides of the discharge duct 43 may be moved to positions where both lateral sides of the discharge duct 43 coincide with both lateral sides of the air outlet 133 under guidance of the first plates 1511 of the position guides 151.

While the discharge duct 43 is moved toward the air outlet 133, the bottom of the outer peripheral surface (bottom surface) of the discharge duct 43 is adjustable in height by the slope 1515 of the height guide 153. In this way, the top and bottom of the outer peripheral surface of the discharge duct 43 may coincide with the top and bottom of the outer periphery of the air outlet 133 while the discharge duct 43 is moved toward the air outlet 133.

Meanwhile, if the width of the discharge duct 43, as exemplarily shown in FIG. 2, is not constant, the position guides 151 may include a pair of front position guides arranged on the base panel 15 at the front side of the discharge duct 43, and a pair of rear position guides arranged on the base panel 15 at the rear side of the discharge duct 43 (i.e. arranged at positions adjacent to the air outlet 133).

In this case, the pair of front position guides must be spaced apart from each other by a distance corresponding to the front width of the discharge duct 43, and the pair of rear position guides must be spaced apart from each other by a distance corresponding to the rear width of the discharge duct 43.

The filter assembly 5 included in the laundry treatment apparatus 100 of the present invention is arranged in a direction parallel to the rotating axis C of the drum 2 (i.e. arranged in a longitudinal direction of the drum 2) to filter air discharged from the drum 2.

More specifically, the filter assembly 5 included in the laundry treatment apparatus 100 of the present invention is separably provided in the discharge duct 43 rather than the connection duct 41, thereby filtering air discharged from the drum 2.

In the case of a conventional laundry treatment apparatus, the connection duct 41 is provided with a filter. However, the length of the connection duct 41 is not variable so long as the height of the laundry treatment apparatus is not varied, which makes it difficult to increase the filtration capacity of the filter.

On the other hand, the laundry treatment apparatus 100 of the present invention may achieve significant increase in the filtration capacity of the filter assembly 5 because the filter assembly 5 is provided in the discharge duct 43 extending in a longitudinal direction of the drum 2 (parallel to the rotating axis C of the drum 2).

Accordingly, the laundry treatment apparatus 100 of the present invention may be utilized as a commercial laundry treatment apparatus that must be capable of drying large amounts of laundry per load.

Meanwhile, the filter assembly 5 may be separably coupled to the discharge duct 43. To this end, the front panel 11 may be provided with a filter support panel 19.

Figure 3:
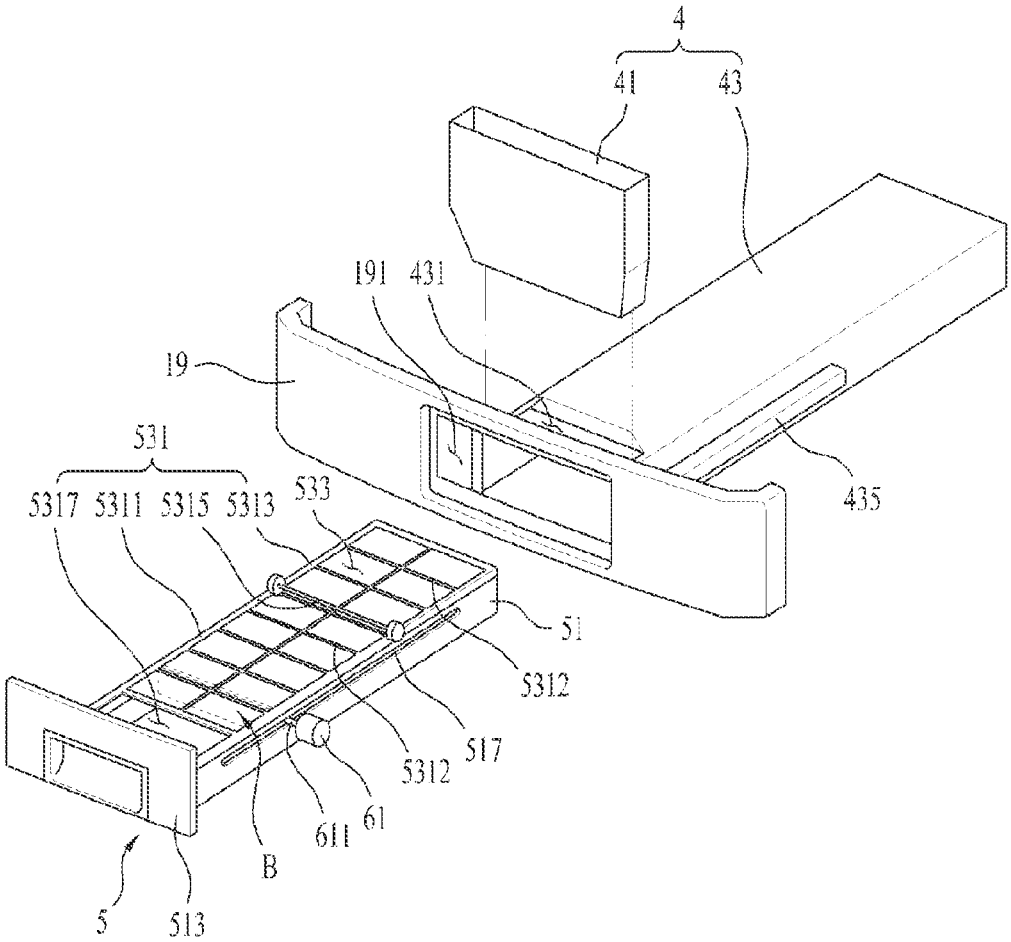
FIG. 3 is a view showing a filter assembly and a discharge duct according to the present invention.

As exemplarily shown in FIG. 3, the filter support panel 19 has a filter insertion hole 191 for insertion of the filter assembly 5. The filter support panel 19 may be located below the front panel 11 (i.e. below the door 13).

Hereinafter, a configuration of the filter assembly 5 will be described with reference to FIGS. 3 and 4.

Figure 4:
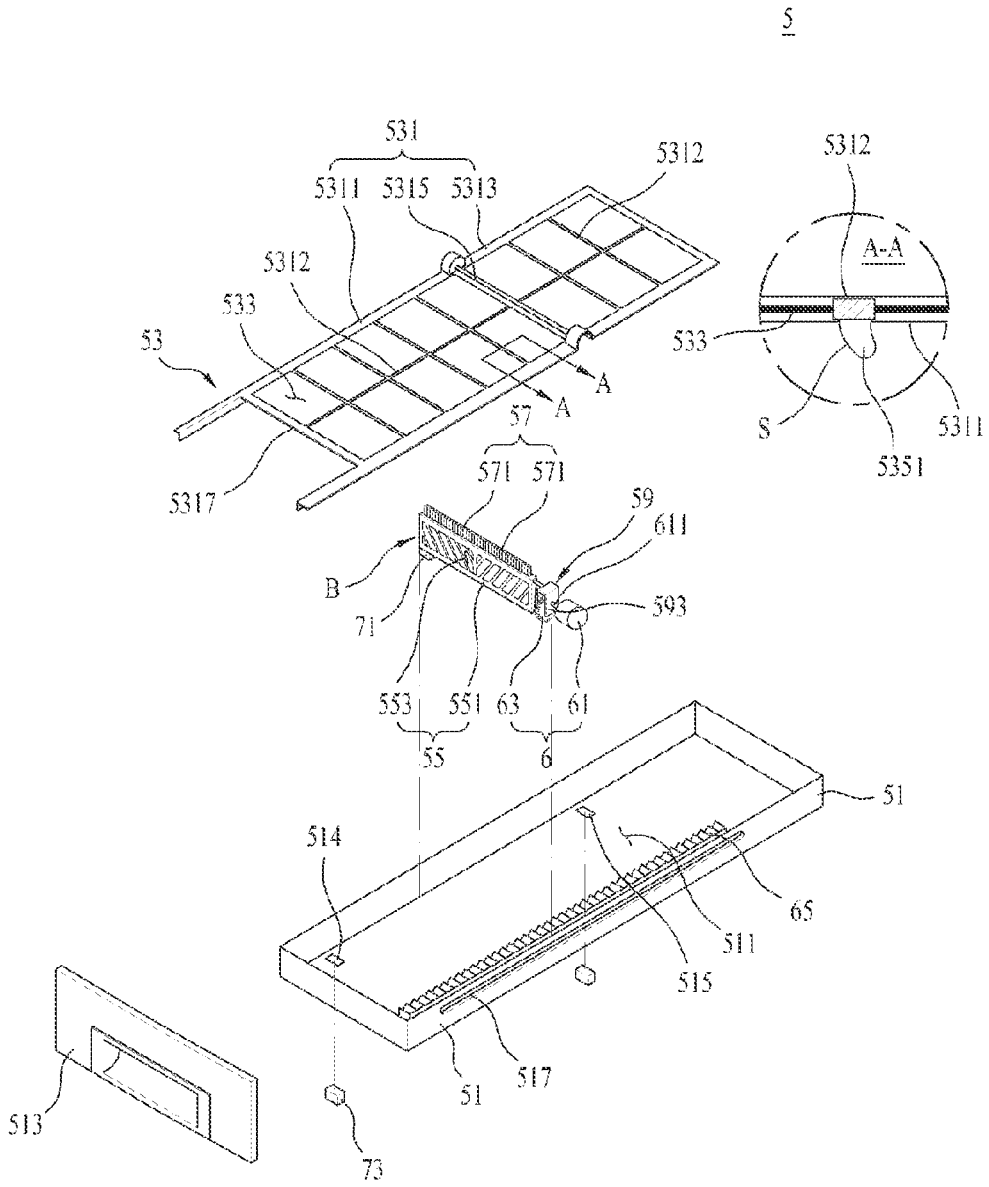
FIG. 4 is an exploded perspective view of a filter assembly according to the present invention.

As exemplarily shown in FIG. 4, the filter assembly 5 includes a housing 51 defining a storage space 511 in which impurities are stored.

The housing 51 is configured to be inserted into the discharge duct 43 through the filter insertion hole 191 of the filter support panel 19. The housing 51 may be provided with a handle 513 to facilitate introduction and retraction of the housing 51.

The housing 51 may be a hexahedral housing, one side of which facing the connection duct 41 is open. In this case, a filter unit 53 is located at the open side of the housing 51.

An impurity remover unit B is accommodated in the housing 51 and serves to remove impurities remaining on the filter unit 53 and compress the impurities removed from the filter unit 53 within the housing 51.

The impurity remover unit B may include a brush 57 configured to separate impurities remaining on the filter unit 53, and a compressor 55 configured to compress the impurities separated by the brush 57 within the storage space 511. This will be described later in detail.

The filter unit 53 consists of a filter frame 531 located at the open side of the housing 51 and a filter 533 secured to the filter frame 531.

The filter frame 531 has an air introduction hole 5317 communicating with the duct connection hole 431. Accordingly, the air discharged from the drum 2 through the connection duct 41 is introduced into the housing 51 through the duct connection hole 431 and the air introduction hole 5317, and in turn the air introduced into the housing 51 is discharged outward from the housing 51 (from the interior of the discharge duct 43) by way of the filter 533.

In this case, the discharge duct 43 may further be provided with a path guide (433, see FIG. 7) to allow air discharged from the connection duct 41 to move to the air introduction hole 5317.

The path guide 433 extends from an outer periphery of the duct connection hole 431 perforated in the discharge duct 43 toward the filter frame 531. Accordingly, the path guide 433 may serve not only to guide air discharged from the connection duct 41 to the air introduction hole 5317, but also to guide the filter assembly 5 when the filter assembly 5 is inserted into or retracted from the discharge duct 43 through the filter insertion hole 191.

Moreover, a filter guide (434, see FIG. 7) may further be provided in the discharge duct 43 to support an upper surface of the filter assembly 5 (more particularly, the filter frame 531).

This may serve not only to guide the filter assembly 5 when the filter assembly 5 is inserted into or retracted from the discharge duct 43 through the filter insertion hole 191, but also to prevent the filter assembly 5 from being moved within the discharge duct 43 during movement of the impurity remover unit B.

The filter frame 531 may consist of a first frame 5311 having the air introduction hole 5317, and a second frame 5313 rotatably coupled to the first frame 5311 via a frame rotating shaft 5315. This serves to ensure easy removal of impurities stored in the storage space 511 of the housing 51.

When removal of impurities stored in the housing 51 is needed, the user must first retract the filter assembly 5 from the discharge duct 43, and then separate the filter frame 531 from the housing 51, in order to remove impurities stored in the housing 51.

One of important features of the filter assembly 5 included in the laundry treatment apparatus 100 of the present invention is to maximize air filtration capacity, which may result in increase in the size and weight of the housing 51. Accordingly, if the filter frame 531 is constructed by a single frame, the user may be inconvenienced by having to remove impurities within the housing 51 due to the weight of the filter assembly 5.

However, the filter frame 531 according to the present invention may solve the above-described problem because the filter frame 531 consists of the first frame 5311 and the second frame 5313, and the second frame 5313 is rotatably coupled to the first frame 5311 and is separable from the housing 51.

Meanwhile, as described above, the impurity remover unit B may include the brush 57 and the compressor 55.

The brush 57 is configured to reciprocate within the housing 51 (more particularly, within the storage space 511) and serves to separate impurities remaining on the filter 533. The compressor 55 is configured to reciprocate within the housing 51 and serves to compress impurities stored in the storage space 511.

Accordingly, if the brush 57 is located at an upper surface of the compressor 55 and has a plurality of brush bosses 571 to come into contact with the filter 533, both the brush 57 and the compressor 55 may be operated using only a single drive unit 6 (brush drive unit) that serves to reciprocate the brush 57 within the storage space 511.

In this case, the filter frame 531 may further be provided with a scraper 535 to separate impurities from the brush 57.

The filter frame 531 may have a plurality of ribs 5312 configured to support the filter 533, and the scraper 535 may have a plurality of scarper bosses 5351 protruding from the rib 5312.

The plurality of brush bosses 571 may be arranged at a predetermined interval on the upper surface of the compressor 55. The respective brush bosses 571 may be arranged to pass each space between one scarper boss 5351 and the other scrapper boss 5351.

More specifically, the plurality of brush bosses 571 may be spaced apart from one another so as to pass each space between one scraper boss 5351 and the other scraper boss 5351 when the brush 57 reciprocates within the storage space 511 (see FIG. 5).

This serves to prevent the brush bosses 571 from coming into contact with the scraper bosses 5351 and from hindering movement of the compressor 55 when the compressor 55 reciprocates within the storage space 511.

On the other hand, assuming that the scraper bosses 5351 are configured to come into contact with the brush bosses 571, in order to prevent the scraper bosses 5351 from hindering movement of the compressor 55 to the maximum extent, each scraper boss 5351 may have a scraper slope S formed at a side thereof facing the air introduction hole 5317.

The compressor 55 may include a compression plate 551 which is placed within the housing 51 to reciprocate within the housing 51 by the drive unit 6.

In this case, the compressor 55 may further include a plurality of through-holes 553 perforated in the compression plate 551. The through-holes 553 serve to prevent reduction in flow rate due to the compression plate 551, deterioration of functions of the compression plate 551, and breakdown of the drive unit 6.

Since the compression plate 551 is configured to reciprocate within the housing 51, the compression plate 551 may prevent air introduced into the housing 51 through the air introduction hole 5317 from moving rearward of the housing 51 if the compression plate 551 is not provided with the through-holes 553. Therefore, the compression plate 551 having no through-holes 553 may reduce the air filtration capacity of the filter assembly 5.

In addition, if the compression plate 551 has no through-holes 553, the compression plate 551 may fail to implement normal reciprocation due to resistance of air introduced into the housing 51, and may cause breakdown of the drive unit 6.

Accordingly, the through-holes 553 of the compression plate 551 according to the present invention may prevent the above-described problem.

The compression plate 551 may further be provided at one side thereof with a shaft support portion 59. The shaft support portion 59 is configured to support the drive unit 6 that reciprocates the compression plate 551 within the housing 51.

The drive unit 6 may include a motor 61 secured to the compression plate 551 via the shaft support portion 59, a motor gear 63 coupled to a rotating shaft 611 of the motor 61 and located within the housing 51, and a rack 65 located within the housing 51 to extend in a longitudinal direction of the housing 51, the rack 65 being engaged with the motor gear 63.

The motor 61 is located at the exterior of the housing 51 and serves to move the impurity remover unit B by being moved along with the impurity remover unit B. To this end, the housing 51 further has a slit 517 for insertion of the rotating shaft 611.

The slit 517 is formed in one surface of the housing 51 and extends in a longitudinal direction of the housing 51 by a given length. FIG. 4 shows one example in which the slit 517 is formed in a longitudinal surface of the housing 51.

Note that the slit 517 may be replaced by a recess 519 indented from an upper end of the housing 51 as exemplarily shown in FIG. 6(*a*). In this case, the filter frame 531 is located above the recess 519, and thus the rotating shaft 611 of the motor 61 may be stably supported by the recess 519 and the filter frame 531.

Meanwhile, interference between the motor 61 and the discharge duct 43 may occur while the motor 61 is reciprocating at the outside of the housing 51 (under control of a rotating direction of the rotating shaft 611 by a controller (not shown)). To prevent this interference, the discharge duct 43 may further have a motor receiving portion (435, see FIG. 6(*b*)) in which the motor 61 is received.

The motor receiving portion 435 may protrude from one surface of the discharge duct 43 in a longitudinal direction of the discharge duct 43.

Accordingly, it is possible to prevent interference between the motor 61 and the discharge duct 43 even if the impurity remover unit B reciprocates within the housing 51 in a state in which the filter assembly 5 is inserted into the discharge duct 43.

In addition, the motor receiving portion 435 may prevent interference between the motor 61 and the discharge duct 43 when the filter assembly 5 is inserted into the discharge duct 43 or retracted from the discharge duct 43.

As exemplarily shown in FIG. 6(*c*), the motor receiving portion 435 may take the form of a duct slit 437 formed in a longitudinal surface of the discharge duct 43.

The rack 65, as exemplarily shown in FIG. 4, is fixed within the housing 51 in a longitudinal direction of the housing 51 (i.e. in a longitudinal direction of the filter unit 53).

The rack 65 may consist of a bar extending in a longitudinal direction of the housing 51, and gears formed at a surface of the bar so as to be tooth-engaged with the motor gear 63.

The shaft support portion 59 may have various configurations so long as the shaft support portion 59 secures the drive unit 6 to the impurity remover unit B. A configuration shown in FIG. 5 is provided by way of example.

FIG. 5(*a*) shows a configuration in which the shaft support portion 59 consists of a first flange 591 secured to the compression plate 551 and a second flange 593 spaced apart from the first flange 591 by a predetermined distance.

In this case, the first flange 591 has a shaft receiving hole 592 (that may be perforated or recessed in the first flange 591 as necessary) for reception of the rotating shaft 611, and the second flange 593 has a shaft penetration hole 594 for penetration of the rotating shaft 611. The motor gear 63 is secured to the rotating shaft 611 and is located in a space between the first flange 591 and the second flange 593.

Accordingly, if the motor gear 63 is rotated via rotation of the rotating shaft 611, the motor 61 is moved along the rack 65 in a longitudinal direction of the housing 51. As the motor 61 is moved in a longitudinal direction of the housing 51, the impurity remover unit B to which the motor 61 is secured may be moved within the housing 51.

FIG. 5(*b*) shows another embodiment of the shaft support portion 59. The shaft support portion 59 according to the present embodiment includes a cylindrical shaft receiving housing 595 secured to the impurity remover unit B, and a shaft penetration hole 596 perforated in one surface of the shaft receiving housing 595.

The shaft receiving housing 595 takes the form of a hollow cylinder and is secured to the compression plate 551. The rotating shaft 611 of the motor 61 is inserted into the shaft penetration hole 596.

In this case, the rotating shaft 611 of the motor 61 may be provided with a shaft flange 613 to prevent the rotating shaft 611 of the motor 61 from being separated from the shaft receiving housing 595.

That is, the shaft flange 613 is located in the shaft receiving housing 595 to prevent the rotating shaft 611 from being retracted from the shaft receiving housing 595 through the shaft penetration hole 596.

Accordingly, the impurity remover unit B may be moved in a longitudinal direction of the housing 51 (i.e. in a longitudinal direction of the filter unit 53) along with the drive unit 6.

Meanwhile, the laundry treatment apparatus 100 of the present invention may further include a storage quantity sensing unit that judges the quantity of impurities stored in the storage space 511 of the housing 51.

The storage quantity sensing unit may have any shape suitable to sense the quantity of impurities within the storage space 511.

FIG. 7 shows one example of the storage quantity sensing unit that is adapted to sense a position of the compressor 55 or the brush 57 upon operation of the drive unit 6, thereby judging the quantity of impurities stored in the storage space 511, and thus the storage quantity sensing unit will hereinafter be referred to as a position sensing unit 7.

The position sensing unit 7 according to the present invention may include a magnetism generator (71, see FIG. 4) provided at the compressor 55 or the brush 57, and at least two magnetism sensors 73 and 75 adapted to sense a position of the magnetism generator 71.

As exemplarily shown in FIG. 3, if the magnetism generator 71 is provided at the compressor 55, the magnetism sensors 73 and 75, as exemplarily shown in FIG. 7, may be fixed within the discharge duct 43 to sense the magnetism generator 71 through holes 514 and 515 perforated in a bottom surface of the housing 51 defining the storage space 511.

The magnetism generator 71 may be a permanent magnet or an electromagnet. The magnetism sensors 73 and 75 may be reed switches that generate an ON-OFF control signal using magnetism provided by the magnetism generator 71 to transmit the control signal to the controller (not shown).

The magnetism sensors may include a first magnetism sensor 73 that senses whether or not the compressor 55 is located at a preset initial position (a first reciprocation threshold position L1 of the compressor 55), and a second magnetism sensor 75 that judges whether or not the storage quantity of impurities exceeds a preset storage quantity.

The initial position may be set to any position within the housing 51 so long as the compressor 55 does not hinder flow of air introduced into the filter assembly 5 through the air introduction hole 5317. FIG. 7 shows the case in which the initial position is set to a front surface of the housing 51 (one surface of the housing 51 where the handle 513 is located, or a space between the air introduction hole 5317 and the handle 513).

Once the filter assembly 5 is inserted into the discharge duct 43, the first magnetism sensor 73 and the magnetism generator 71 may face each other through the first hole 514 perforated in the bottom surface of the housing 51.

The second magnetism sensor 75 is positioned to judge the maximum quantity of impurities that may be stored in the housing 51.

The maximum quantity of impurities that may be stored in the housing 51 may be set to a position where drying efficiency is seriously deteriorated (a second reciprocation threshold position L2).

Accordingly, the controller (not shown) may check whether or not the first magnetism sensor 73 senses the magnetism generator 71 before operation of the laundry treatment apparatus 100, thereby checking whether or not the brush 57 or the compressor 55 is located at an initial position and whether or not the filter assembly 5 is mounted in the discharge duct 43.

Meanwhile, when judging that the filter assembly 5 is mounted in the discharge duct 43, the controller (not shown) controls periodic cleaning of the filter 533 using the impurity remover unit B while supplying air into the drum 2 via the air supply unit 3. In this case, the controller (not shown) controls a rotating direction of the rotating shaft 611 provided at the motor 61, thereby causing reciprocation of the impurity remover unit B within the housing 51.

That is, the controller (not shown) may control the motor 61 by rotating the rotating shaft 611 of the motor 61 clockwise or counterclockwise when the first magnetism sensor 73 senses the magnetism generator 71, and changing a rotating direction of the rotating shaft 611 when the second magnetism sensor 75 senses the magnetism generator 71.

In the above-described process, the controller (not shown) may check whether or not the second magnetism sensor 75 senses the magnetism generator 71 during operation of the impurity remover unit B, thereby judging a removal time of impurities stored in the filter assembly 5.

Accordingly, in the present invention, the controller (not shown) may request that the user remove impurities stored in the filter assembly 5 (stop operation of the rotating shaft 611 of the motor 61) via an alarm device (display device (not shown)) or a speaker (not shown), for example, if the second magnetism sensor 75 does not sense the magnetism generator 71.

As is apparent from the above description, the present invention may provide a laundry treatment apparatus which may increase the filtration capacity of a filter.

Further, the present invention may provide a laundry treatment apparatus which may provide a configuration to increase the quantity of hot air to be supplied into a drum in which laundry is received and to increase the filtration capacity of a filter, thereby being usable as a commercial drying machine.

Furthermore, the present invention may provide a laundry treatment apparatus which may judge whether or not a filter is mounted in the laundry treatment apparatus and judge the quantity of impurities remaining on the filter.

In addition, the present invention may provide a laundry treatment apparatus which may inform a user of a cleaning time of a filter based on the quantity of impurities remaining on the filter.

It will be apparent that, although the preferred embodiments have been shown and described above, the invention is not limited to the above-described specific embodiments, and various modifications and variations can be made by those skilled in the art without departing from the gist of the appended claims. Thus, it is intended that the modifications and variations should not be understood independently of the technical sprit or prospect of the invention.

What is claimed is:

1. A laundry treatment apparatus comprising:

a cabinet defining an external appearance of the laundry treatment apparatus;

a drum rotatably supported within the cabinet and configured to receive laundry;

a connection duct that is configured to receive air discharged from the drum;

a discharge duct that is configured to extend in a longitudinal direction of the drum and that is connected to the connection duct;

a filter assembly comprising:

a filter unit located in the discharge duct and that is configured to filter air;

an impurity remover unit that is configured to remove impurities remaining on the filter unit and compress impurities removed from the filter unit;

a housing located in the discharge duct, the housing being configured to support the filter unit and to receive the impurity remover unit; and a slit that is configured to extend in a longitudinal direction of the housing and that enables communication between an interior and an exterior of the housing;

a drive unit secured to the impurity remover unit, the drive unit being configured to cause the impurity remover unit to reciprocate over a predetermined area of the filter unit, wherein the drive unit comprises a motor with a rotating shaft that is inserted into the slit and that is configured to be rotatably coupled to the impurity remover unit, the motor being located at the exterior of the housing and configured to reciprocate in a longitudinal direction of the filter unit along with the impurity remover unit.

2. The apparatus according to claim 1, wherein the cabinet has a filter insertion hole that is configured to communicate with the discharge duct, and wherein the filter assembly and the drive unit are configured to pass through the filter insertion hole based on the filter assembly and the drive unit being inserted into the discharge duct or separated from the discharge duct.

3. The apparatus according to claim 2, wherein air discharged from the connection duct is introduced into the housing, and the housing defines a storage space for impurities removed from the filter unit by the impurity remover unit.

4. The apparatus according to claim 3, wherein the filter unit includes a filter frame secured to the housing, an air introduction hole that is defined in the filter frame and that is configured to allow air discharged from the connection duct to be introduced into the housing, and a filter attached to the filter frame and that is configured to filter air that moves from the housing to the discharge duct, and wherein the impurity remover unit is configured to reciprocate within the housing, separate, from the filter, impurities remaining on the filter, and compress the separated impurities within the housing.

5. The apparatus according to claim 4, wherein the filter frame includes:

a first frame having the air introduction hole, the first frame being secured to the housing; and a second frame rotatably coupled to the first frame, the second frame being separable from the housing.

6. The apparatus according to claim 4, wherein the drive unit is configured to reciprocate in a longitudinal direction of the housing and reciprocate the impurity remover unit within the housing.

7. The apparatus according to claim 6, wherein the drive unit further comprises:

a rack that is located within the housing and that is configured to extend in a longitudinal direction of the housing; and a motor gear coupled to the rotating shaft, the motor gear being located within the housing and engaged with the rack.

8. The apparatus according to claim 7, wherein the impurity remover unit comprises:

a compressor to which the rotating shaft is rotatably coupled, the compressor being configured to compress impurities within the housing; and a brush that is configured to protrude from the compressor and that is arranged to contact the filter.

9. The apparatus according to claim 8, wherein the filter assembly further includes a scraper that is located at the filter frame and that is configured to separate, from the brush, impurities remaining on the brush.

10. The apparatus according to claim 9, wherein the scraper has a plurality of scraper bosses protruding from the filter frame, wherein the brush has a plurality of brush bosses protruding from the compressor, and wherein the brush bosses are configured to pass through spaces between adjacent scraper bosses.

11. The apparatus according to claim 8, wherein the compressor comprises:

a compression plate configured to reciprocate within the housing and compress impurities; and a shaft support portion secured to the compression plate, the rotating shaft being rotatably coupled to the shaft support portion.

12. The apparatus according to claim 11, wherein the compressor further includes at least one through-hole perforated in the compression plate.

13. The apparatus according to claim 11, wherein the shaft support portion comprises:

a first flange secured to the compression plate and that is configured to receive the rotating shaft; and a second flange spaced apart from the first flange by a predetermined distance, the second flange having a shaft penetration hole that is configured to allow the rotating shaft to penetrate the second flange, and wherein the motor gear is located in a space between the first flange and the second flange.

14. The apparatus according to claim 1, further comprising a position sensing unit configured to sense a position of the impurity remover unit.

15. The apparatus according to claim 14, wherein the position sensing unit comprises a sensor configured to sense whether the impurity remover unit reaches a threshold position to indicate whether a maximum quantity of impurities are stored in the filter assembly.

16. The apparatus according to claim 14, wherein the position sensing unit comprises:

a first sensor configured to sense whether the impurity remover unit reaches a first threshold position to indicate whether the filter assembly is located in the discharge duct; and a second sensor configured to sense whether the impurity remover unit reaches a second threshold position to indicate whether a maximum quantity of impurities are stored in the filter assembly.

17. The apparatus according to claim 14, wherein the position sensing unit comprises:

a magnetism generator secured to the impurity remover unit; and a magnetism sensor that is configured to generate a control signal based on the magnetism generator reaching a preset position.

18. The apparatus according to claim 17, wherein the magnetism sensor is a first magnetism sensor configured to generate a control signal based on the magnetism generator reaching a first preset position, further comprising:

a second magnetism sensor configured to generate a control signal based on the magnetism generator reaching a second preset position.

19. The apparatus according to claim 18, wherein the filter assembly further includes a housing configured to receive the impurity remover unit and to secure the filter unit above the impurity remover unit such that impurities, removed from the filter unit by the impurity remover unit, are stored in the housing, a first hole perforated in a bottom surface of the housing, and a second hole perforated in the bottom surface of the housing and spaced apart from the first hole by a predetermined distance, and wherein the first magnetism sensor is fixed in the discharge duct at a position below the first hole, and the second magnetism sensor is fixed in the discharge duct at a position below the second hole.

20. The apparatus according to claim 19:

wherein the first sensor is configured to sense whether the impurity remover unit reaches the first preset position to indicate whether the housing is located in the discharge duct; and wherein the second sensor configured to sense whether the impurity remover unit reaches the second preset position to indicate whether a maximum quantity of impurities are stored in the housing.

* * * * *